US011090215B2

(12) United States Patent
Bailey

(10) Patent No.: US 11,090,215 B2
(45) Date of Patent: Aug. 17, 2021

(54) WALKER

(71) Applicant: Patrick E. Bailey, Hutto, TX (US)

(72) Inventor: Patrick E. Bailey, Hutto, TX (US)

( * ) Notice: Subject to any disclaimer, the term of this patent is extended or adjusted under 35 U.S.C. 154(b) by 0 days.

(21) Appl. No.: 16/899,089

(22) Filed: Jun. 11, 2020

(65) Prior Publication Data

US 2020/0397643 A1 Dec. 24, 2020

Related U.S. Application Data

(60) Provisional application No. 62/862,789, filed on Jun. 18, 2019.

(51) Int. Cl.
*A61H 3/04* (2006.01)

(52) U.S. Cl.
CPC ..... *A61H 3/04* (2013.01); *A61H 2201/1253* (2013.01); *A61H 2201/169* (2013.01); *A61H 2201/1638* (2013.01); *A61H 2203/0406* (2013.01)

(58) Field of Classification Search
CPC ..... A61H 3/04
USPC ..... 135/67
See application file for complete search history.

(56) References Cited

U.S. PATENT DOCUMENTS 2,278,901 A * 4/1942 Smock ..... A61H 3/04 482/67
2,316,100 A * 4/1943 Arvid ..... A47D 13/043 280/87.05
2,594,051 A * 4/1952 McFarland ..... A61H 3/00 482/67
4,021,033 A * 5/1977 Auclair ..... A63B 69/0022 482/66
4,342,465 A * 8/1982 Stillings ..... A61H 3/04 135/67
4,953,851 A * 9/1990 Sherlock ..... A61H 3/04 237/6
5,152,730 A * 10/1992 Hoffman ..... A61H 3/008 135/67
5,156,176 A * 10/1992 Doorenbos ..... A61H 3/04 135/67
5,255,697 A * 10/1993 Grauer ..... A61H 3/04 135/67
5,443,304 A * 8/1995 Fochs ..... A61H 3/04 135/67
5,476,432 A * 12/1995 Dickens ..... A61H 3/04 135/67
D370,195 S * 5/1996 Santos ..... D12/128
5,800,318 A * 9/1998 Coviello ..... A61H 3/04 135/67
5,803,103 A * 9/1998 Haruyama ..... A61H 3/04 135/67
5,813,948 A * 9/1998 Quigg ..... A61H 3/04 280/87.041
6,170,840 B1 * 1/2001 Mathias ..... A63B 69/0064 135/69

(Continued)

*Primary Examiner* — David R Dunn
*Assistant Examiner* — Danielle Jackson
(74) *Attorney, Agent, or Firm* — Barnes & Thornburg LLP

(57) ABSTRACT

A walker comprising a handle base and a frame. The handle base is configured to be gripped by a user of the walker. The frame is coupled with the handle base and configured to support the handle base above ground underlying the walker. The handle base and the frame cooperate to define a user space sized to allow the user of the walker to stand in the user space.

20 Claims, 5 Drawing Sheets

(56) References Cited

U.S. PATENT DOCUMENTS

| | | | | |
|---|---|---|---|---|
| 8,663,136 | B1 * | 3/2014 | Alsaffar | A61H 3/04 601/35 |
| 8,720,914 | B1 * | 5/2014 | Heath | A61H 3/04 280/87.021 |
| 9,278,042 | B2 * | 3/2016 | Osterhaus | A61H 3/008 |
| 9,314,114 | B2 * | 4/2016 | Davis | A47D 13/04 |
| 9,456,952 | B2 * | 10/2016 | Cook | A61H 3/008 |
| 9,554,962 | B1 * | 1/2017 | Smith | A61H 3/04 |
| 10,583,066 | B1 * | 3/2020 | Abroms | A61H 3/04 |
| 10,786,419 | B2 * | 9/2020 | Hoekelmann | A63B 21/0004 |
| 2004/0020525 | A1 * | 2/2004 | Lev | A61H 3/04 135/66 |
| 2005/0183759 | A1 * | 8/2005 | Wolfe | A61H 3/04 135/67 |
| 2009/0115158 | A1 * | 5/2009 | Lawrence | A61H 3/04 280/200 |
| 2010/0170546 | A1 * | 7/2010 | Popovic | A61H 3/008 135/67 |
| 2014/0276306 | A1 * | 9/2014 | Dreske | A61H 3/008 602/19 |
| 2014/0296039 | A1 * | 10/2014 | Shaw | A61H 3/04 482/68 |
| 2018/0133094 | A1 * | 5/2018 | Helfer | A61H 3/04 |

* cited by examiner

WALKER

CROSS REFERENCE TO RELATED APPLICATIONS

This application claims priority to and the benefit of U.S. Provisional Patent Application No. 62/862,789, filed 18 Jun. 2019, the disclosure of which is now expressly incorporated herein by reference.

FIELD OF THE DISCLOSURE

The present disclosure relates generally to mobility aids, and more specifically to walking aids.

BACKGROUND

Walkers may be used by adult or pediatric users for mobility and standing aids. Pediatric users may suffer from weakness or lack of physical definition in lower extremities that prevent them from independent movement without such walkers and similar devices. These aids may help maintain development milestones and provide independence to the pediatric user.

SUMMARY

The present disclosure may comprise one or more of the following features and combinations thereof.

A walker may include a handle base, a frame, and a rolling base. The frame may be coupled with the handle base. The frame may be configured to support the handle base above ground underlying the walker. The handle base and the frame may cooperate to define a user spaced sized to allow a user of the walker to stand in the user space. The rolling base may be coupled with the frame and configured to allow the walker to roll in all directions relative to the ground and to rotate freely along the ground about a user positioned in the user space. The rolling base may include a plurality of wheel units coupled with the frame. Each of the plurality of wheel units may extend from the frame outwardly away from the user space.

In some embodiments, each of the plurality of wheel units may include a leg and a wheel. The leg may extend substantially horizontally away from the frame and the wheel may be coupled to the leg.

In some embodiments, each wheel is a caster that extends downwardly away from the corresponding leg. The caster may be configured to rotate 360 degrees relative to the corresponding leg about a vertical axis that intersects the corresponding leg.

In some embodiments, the handle base may include a first hand rail that extends substantially horizontally. A leg of a first wheel unit included in the plurality of wheel units may extend away from the first hand rail at an angle theta and the angle theta may be between about and including 40 and 50 degrees.

In some embodiments, the handle base may include a first hand rail, a second hand rail spaced apart from the first hand rail, and a third hand rail that extends between and interconnects the first hand rail and the second hand rail. The first hand rail, the second hand rail, and the third hand rail may each extend substantially horizontally.

In some embodiments, the frame includes a plurality of arms and a plurality of frame rails. The plurality of arms may extend substantially vertically from the handle base. The plurality of frame rails may extend substantially horizontally and interconnect the plurality of arms.

In some embodiments, the plurality of arms may include a first front arm coupled with the first hand rail, a second front arm coupled with the second hand rail, a first rear arm coupled with the first hand rail and third hand rail, and a second rear arm coupled with the second hand rail and third hand rail. In some embodiments, the plurality of frame rails may include a first frame rail coupled with the first front arm and the first rear arm, a second frame rail coupled with the second front arm and the second rear arm, and a third frame rail coupled with the first rear arm and the second rear arm.

In some embodiments, the plurality of wheel units may include a first wheel unit that includes a horizontal leg that extends from the from the first front arm, a second wheel unit that includes a horizontal leg that extends from the second front arm, a third wheel unit that includes a horizontal leg that extends from the first rear arm, and a fourth wheel unit that includes a horizontal leg that extends from the second rear arm.

In some embodiments, each of the plurality of wheel units includes a wheel coupled to the leg of the wheel unit. Each wheel may be a caster that extends downwardly away from the corresponding leg. The caster may be configured to rotate 360 degrees relative to the corresponding leg about a vertical axis that intersects the corresponding leg.

In some embodiments, the handle base has a handle base width, the rolling base has a rolling base width, and the rolling base width is greater than the handle base width. A width ratio between the rolling base width and the handle base width may be between about and including 5:4 and about and including 11:6.

In some embodiments, the handle base has a handle base length, the rolling base has a rolling base length, and the rolling base length is greater than the handle base length. A length ratio between the rolling base width and the handle base width may be between about and including 5:4 and about and including 11:6.

In some embodiments, a length ratio between the rolling base width and the handle base width is between about and including 5:4 and about and including 11:6. In some embodiments, the handle base and the frame comprise polyvinyl chloride. In some embodiments, each of leg comprises polyvinyl chloride.

In some embodiments, the plurality of wheel units include a first wheel unit having a first leg that extends away from the frame and a first wheel coupled with the first leg and a second wheel unit that includes a second leg that extends away from the frame and a second wheel coupled with the second leg. The first leg extends at an angle between 80 and 100 degrees relative to the second leg.

In some embodiments, each of the plurality of wheel units includes a leg that extends substantially horizontally away from the frame and a wheel coupled to the leg. In some embodiments, each wheel included in the plurality of wheel units comprises a caster that extends downwardly away from the corresponding leg. At least one of the casters is configured to rotate 360 degrees relative to the corresponding leg about a vertical axis that intersects the corresponding leg.

According to another aspect of the disclosure, a walker kit may include a plurality of polyvinyl chloride tubes, ten polyvinyl chloride 90-degree elbow fittings, two polyvinyl chloride tee fittings, two 3-way 90-degree elbow fittings, two 4-way tee fittings, and four wheels. The plurality of polyvinyl chloride tubes may include a first hand rail tube, a second hand rail tube, a third hand rail tube, a first frame rail tube, a second frame rail tube, a third frame rail tune, an upper first front arm tube, a lower first front arm tube, an upper second front arm tube, a lower second front arm tube, an upper first rear arm tube, a lower first rear arm tube, an upper second rear arm tube, a lower second rear arm tube, a first leg tube, a second leg tube, a third leg tube, and a fourth leg tube, These and other features of the present disclosure will become more apparent from the following description of the illustrative embodiments.

DETAILED DESCRIPTION OF THE DRAWINGS

Figure 1:
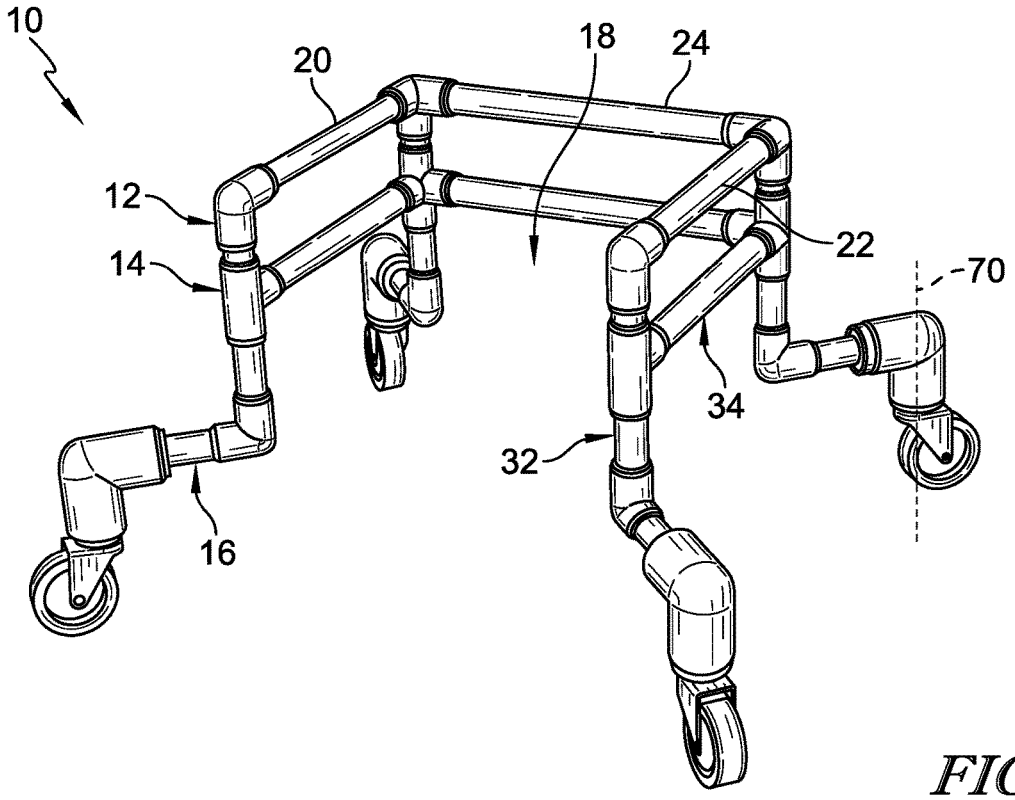
FIG. 1 is a perspective view of a walker according to the present disclosure, the walker including a handle base, a frame configured to support the handle base above the ground, and a rolling base coupled with the frame and configured to allow the walker to move relative to the ground.

For the purposes of promoting an understanding of the principles of the disclosure, reference will now be made to a number of illustrative embodiments illustrated in the drawings and specific language will be used to describe the same.

Figure 3:
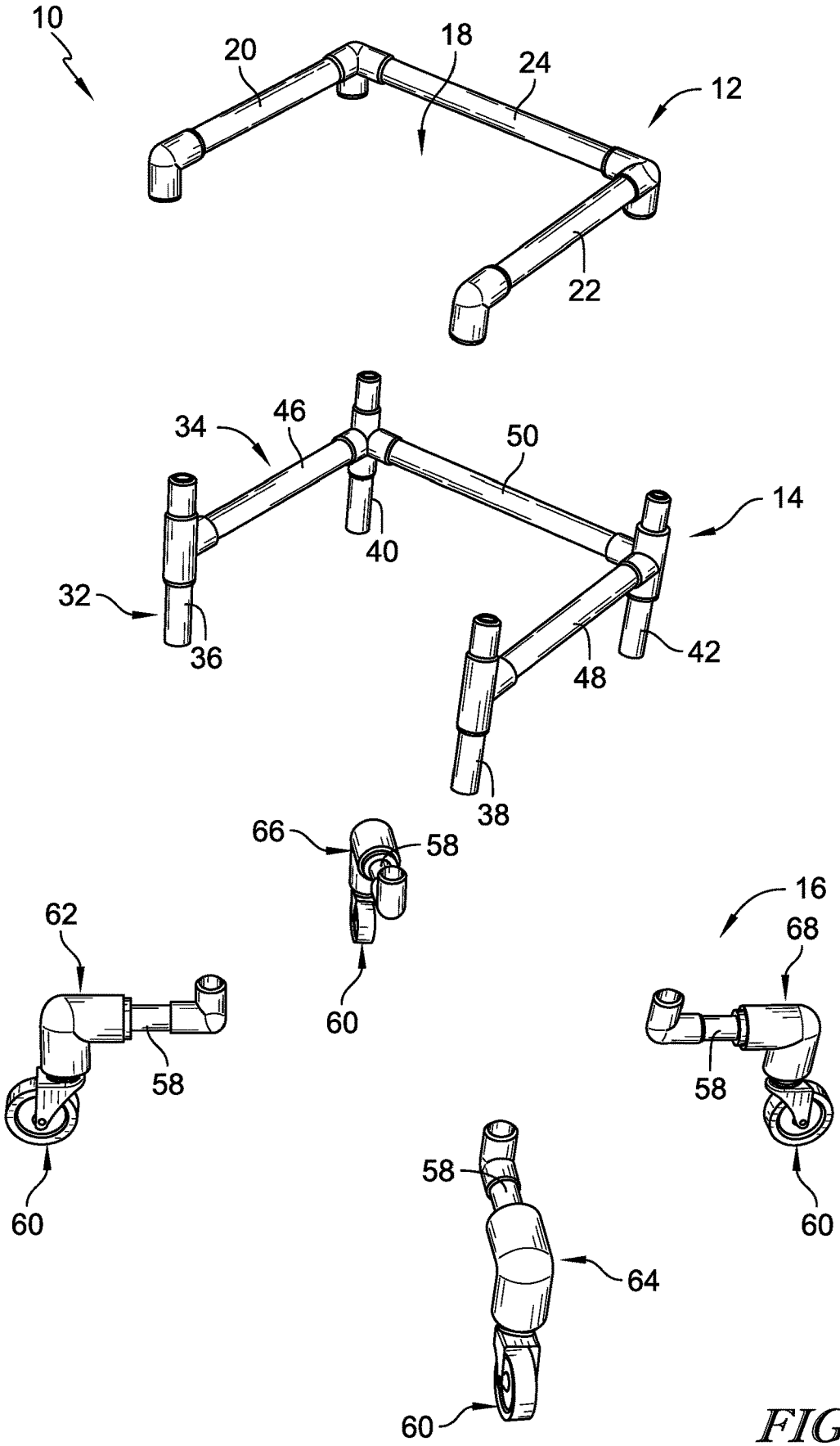
FIG. 3 is an exploded view of the walker of FIG. 1 showing the handle base, the frame, and the rolling base and showing that the rolling base includes a plurality of wheel units configured to couple with the frame.

A walker 10 for aiding the mobility of a user of the walker 10 is shown in FIG. 1. The walker 10 includes a handle base 12, a frame 14, and a rolling base 16 as shown in FIGS. 1 and 3. The handle base 12 is configured to be gripped by or leaned on by the user to support the user above ground underlying the walker 10. The frame 14 is coupled with the handle base 12 to brace the handle base 12 above the ground at a height sufficient to be gripped by or leaned on by the user. The handle base 12 and the frame 14 cooperate to define a user space 18 that opens at a front of the walker 10 and sized for the user to stand within the walker 10. The rolling base 16 is coupled to the frame 14 to allow the walker 10 to roll relative to the ground.

Figure 2:
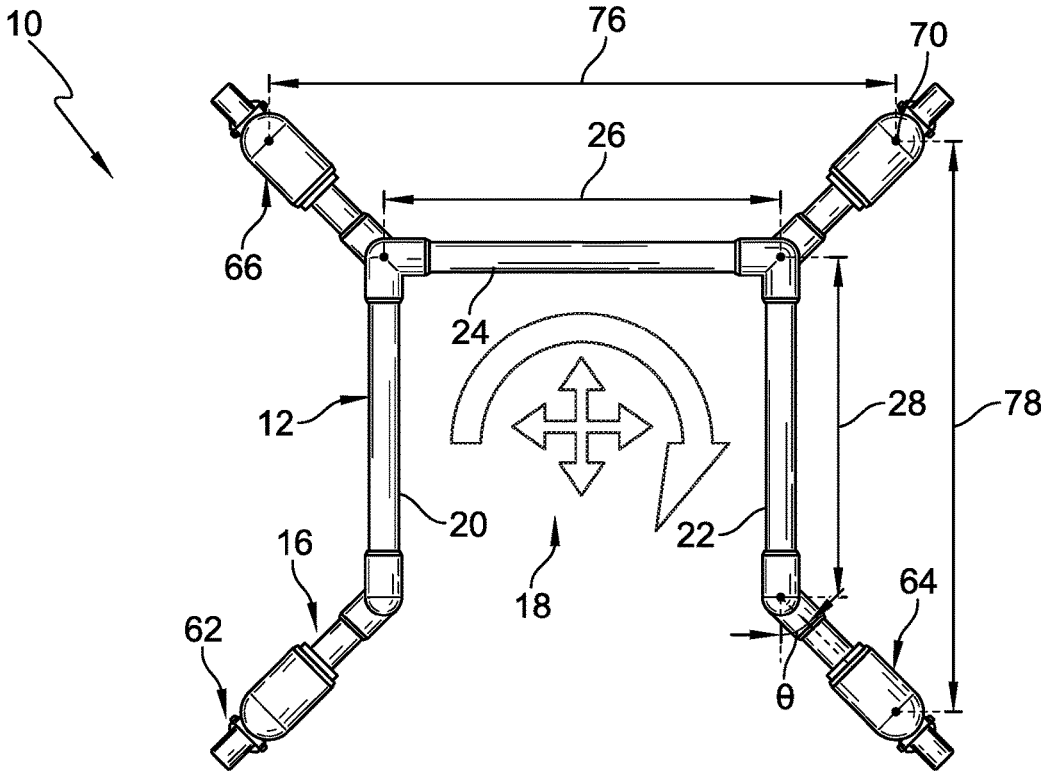
FIG. 2 is a top plan view of the walker of FIG. 1 showing that the rolling base extends outwardly away from the frame and handle base to provide stability to the walker and suggesting that the walker is free to move in all directions and to rotate relative to a user to grant improved mobility to the user.

The rolling base 16 is free to move in all directions relative to the ground and to rotate about a user to grant the user freedom to move in all directions without lifting the walker 10 and to reposition themselves on the walker 10 as suggested in FIG. 2. The handle base 12 is located within a footprint of the frame 14 when viewed from above while the rolling base 16 is located outside the footprint of the frame 14 to stabilize the walker 10 as shown in FIG. 2.

Figure 4:
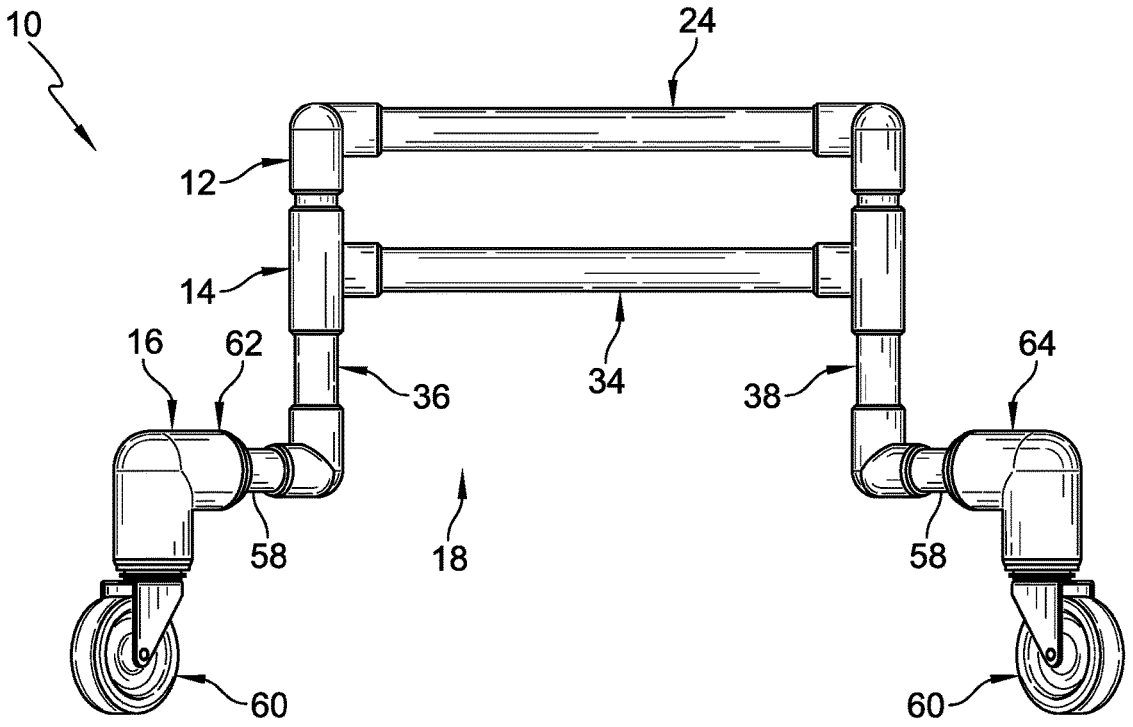
FIG. 4 is a front plan view of the walker of FIG. 1 showing that rails of the handle base and the frame extend horizontally, support arms of the frame extend vertically, and the wheel units of the rolling base extend outward away from the frame.
Figure 5:
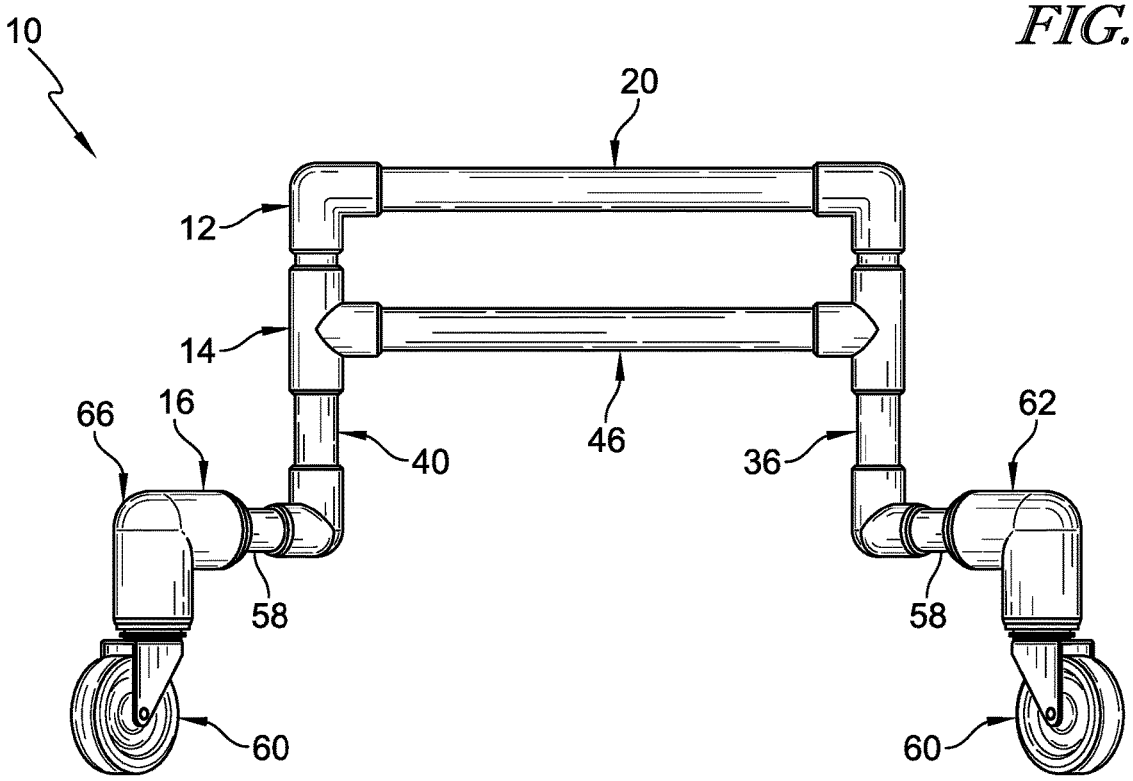
FIG. 5 is a side plan view of the walker of FIG. 1 showing that the rails of the handle base and the frame extend horizontally, the support arms of the frame extend vertically, and the wheel units of the rolling base extend outward away from the frame.

The handle base 12 includes a first hand rail 20, a second hand rail 22, and a third hand rail 24 as shown in FIG. 3. The first hand rail 20 extends substantially horizontal relative to the ground as shown in FIGS. 3 and 5. The second hand rail 22 is spaced apart from the first hand rail 20 to define the user space 18 there between. The second hand rail 22 extends substantially horizontal relative to ground and the second hand rail 22 is substantially parallel with the first hand rail 20 as shown in FIG. 3. The third hand rail 24 extends substantially horizontal between and interconnects the first hand rail 20 and the second hand rail 22 as shown in FIGS. 3 and 4. The third hand rail 24 is substantially perpendicular with the first hand rail 20 and the second hand rail 22. The third hand rail 24 is coupled to ends of the first and second hand rails 20, 22 located toward the back of the walker 10.

The first hand rail 20, the second hand rail 22, and the third hand rail 24 cooperate to define a portion of the user space 18 as shown in FIG. 3. The first hand rail 20, the second hand rail 22, and the third hand rail 24 are each cylindrical shaped in the illustrative embodiment. In other embodiments, the first hand rail 20, the second hand rail 22, and the third hand rail 24 may have a rectangular, circular, oval, eccentric, or any other suitable cross-section shape when viewed front to back. Illustratively, the first hand rail 20, the second hand rail 22, and the third hand rail 24 are made of polyvinyl chloride (PVC). Polyvinyl chloride is relatively lightweight for its strength and tubes of PVC is readably available off the shelf at hardware store.

Figure 6:
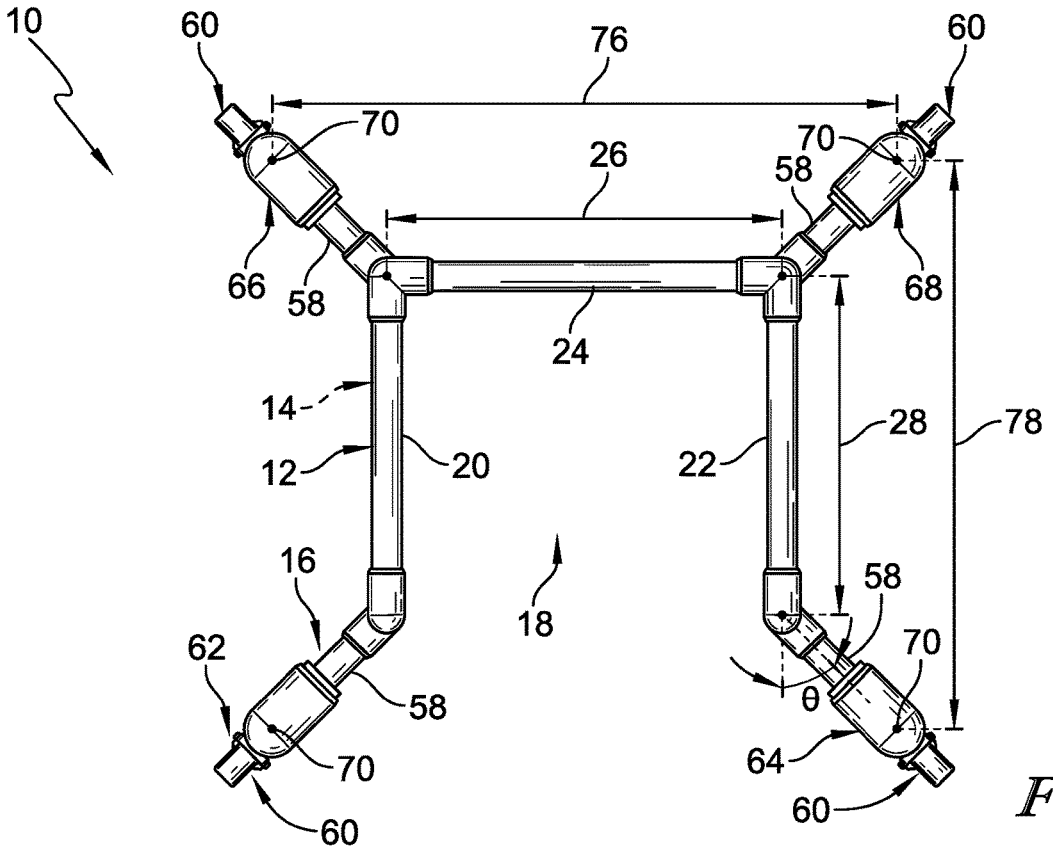
FIG. 6 is a top plan view of the walker of FIG. 1 suggesting that the rolling base extends outside of the handle base and the frame to provide improved stability to the walker and that each wheel unit extends away from the frame at an angle.

The handle base 12 has a footprint defined by a handle base width 26 and a handle base length 28 as shown in FIG. 6. The handle base width 26 is defined by the distance between the first hand rail 20 and the second hand rail 22. Illustratively, the handle base width 26 is defined as being between a midpoint of the first hand rail 20 and a midpoint of the second hand rail 22. The handle base length 26 is defined by the distance between the third hand rail 24 and ends of the first hand rail 20 and the second hand rail 22. Illustratively, the handle base length 26 is defined as being between a midpoint of the third hand rail 24 and the end of the second hand rail 22. The handle base length 26 can also be defined as the length of the first hand rail 20 or second hand rail 22.

The frame 14 includes a plurality of frame arms 32 and a plurality of frame rails 34 as shown in FIGS. 1 and 3. The plurality of frame arms 32 extend vertically and are coupled with the handle base 12 to space the handle base 12 vertically apart from the ground. The plurality of frame rails 34 extend horizontally and are coupled with the plurality of frame arms 32 to reinforce the frame 14. In other embodiments, the plurality of frame rails 34 may be omitted. The plurality of frame rails 34 cooperate to define a portion of the user space 18 as shown in FIG. 3. In some embodiments, filler material 54 is located within the plurality of frame arms 32 and/or the plurality of frame rails 34 to provide additional weight to a lower part of the walker 10 to increase stability of the walker 10 as suggested in FIG. 8.

The plurality of frame arms 32 and the plurality of frame rails 34 are each cylindrical shaped in the illustrative embodiment. In other embodiments, the plurality of frame arms 32 and the plurality of frame rails 34 may have a rectangular, circular, oval, eccentric, or any other suitable cross-section shape. Illustratively, the plurality of frame arms 32 and the plurality of frame rails 34 are made of polyvinyl chloride (PVC).

Figure 8:
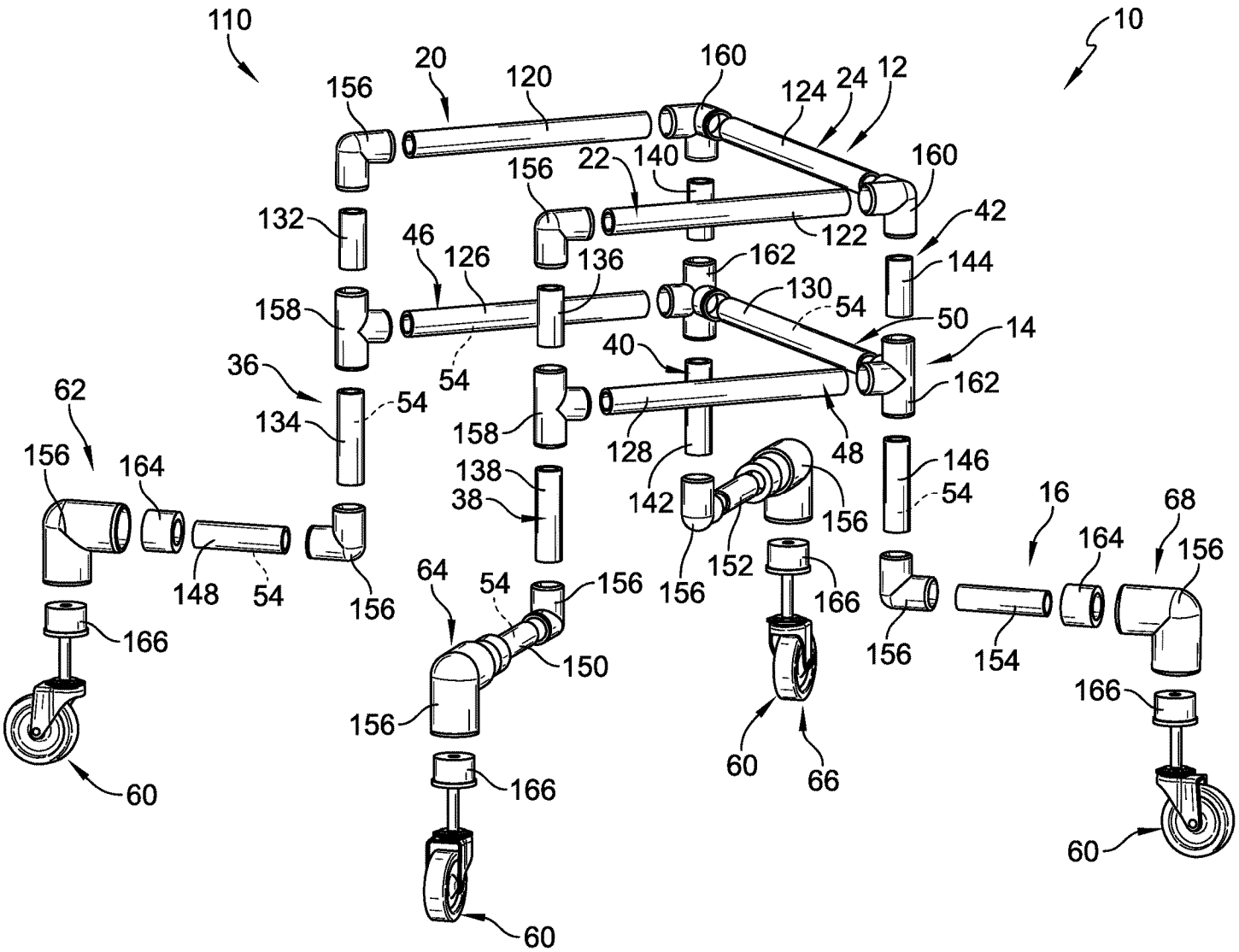
FIG. 8 is an exploded view of each of the handle base, the frame, and the rolling base of the walker of FIG. 1.

The plurality of frame arms 32 includes a first front arm 36, a second front arm 38, a first rear arm 40, and a second rear arm 42 as shown in FIG. 3. As shown in FIG. 8 and discussed in greater detail below, each arm 36, 38, 40, 42 may comprise two or more tubes coupled together via a connector piece. The two or more tubes are coupled with one or more of the plurality of frame rails 34 via the connector pieces.

The first front arm 36 is located at the front of the walker 10 and extends substantially vertically and perpendicular to the first hand rail 20, the second hand rail 22, and the third hand rail 24 as shown in FIGS. 3-5. An end of the first front arm 36 is coupled with the first hand rail 20 at a front end of the first hand rail 20.

The second front arm 38 extends substantially vertically and perpendicular to the first hand rail 20, the second hand rail 22, and the third hand rail 24 as shown in FIGS. 3-5. An end of the second front arm 38 is coupled with the second hand rail 22 at a front end of the second hand rail 22. The second front arm 38 is spaced apart laterally from the first front arm 36 and is located at the front of the walker 10. The first front arm 36 and the second front arm 38 define an opening to allow a user to enter and exit the user space 18. No frame rails 34 extend between the first front arm 36 and the second front arm 38.

The first and second rear arms 40, 42 are spaced apart longitudinally from the first and second front arms 36, 38 and are located toward the back of the walker 10 as shown in FIGS. 3-5. The first rear arm 40 extends substantially vertically and perpendicular to the first hand rail 20, the second hand rail 22, and the third hand rail 24. An end of the first rear arm 40 is coupled with a rear end of the first hand rail 20 and a first lateral end of the third hand rail 24.

The second rear arm 42 is spaced apart laterally from the first rear arm 40 and is located at the rear of the walker 10 as shown in FIG. 3. The second rear arm 42 extends substantially vertically and perpendicular to the first hand rail 20, the second hand rail 22, and the third hand rail 24. An end of the second rear arm 42 is coupled with a rear end of the second hand rail 22 and a second lateral end of the third hand rail 24.

The plurality of frame rails 34 includes a first frame rail 46, a second frame rail 48, and a third frame rail 50 as shown in FIGS. 3-5. As shown in FIG. 8 and discussed in greater detail below, each frame rail 46, 48, 50 may be coupled together and coupled with the frame arms 36, 38, 40, 42 via connector pieces.

The first frame rail 46 extends substantially horizontally. The first frame rail 46 extends between and interconnects the first front arm 36 and the first rear arm 40. The first frame rail 46 is parallel with the first hand rail 20 as shown in FIG. 5 and aligned with the first hand rail 20 when viewed from above as shown in FIG. 6. Illustratively, the first frame rail 46 and the first hand rail 20 have the same lengths.

The second frame rail 48 extends between and interconnects the second front arm 38 and the second rear arm 42 as shown in FIG. 3. The second frame rail 48 extends substantially horizontally. The second frame rail 48 is parallel with the second hand rail 22 and aligned with the second hand rail 22 when viewed from above as shown in FIG. 6. Illustratively, the second frame rail 48 and the second hand rail 22 have the same lengths.

The third frame rail 50 extends between and interconnects the first rear arm 40 and the second rear arm 42 as shown in FIG. 3. The third frame rail 50 extends substantially horizontally. The third frame rail 50 is parallel with the third hand rail 24 and aligned with the third hand rail 24 when viewed from above as shown in FIG. 6. Illustratively, the third frame rail 50 and the third hand rail 24 have the same lengths.

In other embodiments, the plurality of frame arms 32 may include additional frame arms that extend between the first hand rail 20, the second hand rail 22, and the third hand rail 24 and the plurality of frame rails 46, 48, 50. In other embodiments, the plurality of frame rails 34 may include additional frame rails that extend between two or more of the arms 36, 38, 40, 42 to reinforce the frame 14.

The rolling base 16 is coupled with the plurality of frame arms 32 and configured to roll relative to the ground to allow the walker 10 to rotate and move in all directions relative to the ground as suggested in FIG. 2. In other embodiments, the rolling base 16 may be limited to forward and backward rolling and in other embodiments the base 16 may not be rolling and may, instead, be fixed feet for sliding or being lifted from the ground during movement of the user and walker 10.

Figure 7:
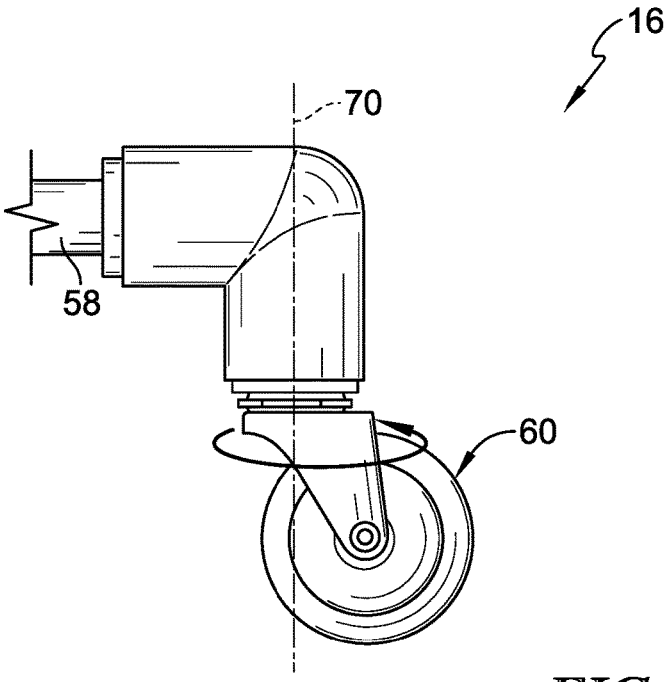
FIG. 7 is an enlarged elevation view of one of the wheel units of the walker suggesting that each wheel unit includes a caster configured to swivel 360 degrees around a caster axis.

The rolling base 16 includes a plurality of wheel units 62, 64, 66, 68 as shown in FIG. 3. Each wheel unit 62, 64, 66, 68 includes a leg 58 and a wheel 60 as shown in FIGS. 3 and 7. Each leg 58 extends outward away from the frame 14 to locate the wheels 60 outside of the handle base width 26 and the handle base length 28 (also referred to as a foot print) of the handle base 12 and the frame 14. Each wheel 60 is coupled with the corresponding leg 58 and configured to rotate to roll along the ground.

Illustratively, each wheel 60 is a caster configured to rotate 360 degrees about a corresponding axis 70 as shown in FIG. 7. The axes 70 extend vertically in the illustrative embodiment. Each wheel 60 is further configured to rotate about a center point of the wheel 60 to allow the wheel to roll.

In other embodiments, each wheel 60 may be fixed to limit rolling of the walker 10 to forward and backward directions. In some embodiments, the front wheels 60 are casters and the rear wheels 60 are fixed for forward and backward directions. In some embodiments, the rear wheels 60 are casters and the front wheels 60 are fixed for forward and backward directions. In some embodiments, two of the wheel units 62, 64, 66, 68 are omitted and vertically extending legs are coupled with two of the arms 36, 38, 40, 42. In other embodiments, vertically extending legs are coupled with two of the legs 58 instead of wheels 60.

The plurality of wheel units 62, 64, 66, 68 includes a first front wheel unit 62, a second front wheel unit 64, a first rear wheel unit 66, and a second rear wheel unit 68 as shown in FIGS. 3 and 6. The first front wheel unit 62 is coupled with the first front arm 36. The second front wheel unit 64 is coupled with the second front arm 38. The first rear wheel unit 66 is coupled with the first rear arm 40. The second rear wheel unit 68 is coupled with the second rear arm 42.

The axis 70 of the plurality of wheel units 62, 64, 66, 68 are spaced apart from one another and located outside a footprint of the handle base 12 and the frame 14 when viewed from above as shown in FIG. 6. A rolling base width 76 is defined between the axis 70 of the first rear wheel unit 66 and the axis 70 of the second rear wheel unit 68. A rolling base length 78 is defined between the axis 70 of the second front wheel unit 64 and the axis 70 of the second rear wheel unit 68. In other embodiments, the rolling base width 76 is the distance between ends of the legs 58 of rear wheel units 66, 68 and the rolling base length 78 is the distance between ends of the legs 58 of the front and the rear wheel units 64, 68. In other embodiments, the rolling base width 76 and the rolling base length 78 are defined by the distance between axes of rotation of the wheels 60 about their center points.

As shown in FIGS. 4 and 5, lower ends of the first front arm 36, the second front arm 38, the first rear arm 40, and the second rear arm 42 are spaced apart from the ground underlying the walker 10 and coupled to legs 58. That is, there is no support directly below those features. As such, elbow joints of the wheel units 62, 64, 66, 68 are free to deform and bend elastically to allow the lower end of the first front arm 36, the second front arm 38, the first rear arm 40, and the second rear arm 42 to move downwardly toward the ground in response to the user applying their weight to the handle base 12 or frame 14. Such bending movement may provide a suspension affect for the walker 10. The bending movement may also lower the center of mass of the walker 10 which may make tipping the walker 10 more difficult.

The rolling base width 76 is greater than the handle base width 26 and the rolling base length 78 is greater than the handle base length 28 so that the rolling base 16 is supported on the ground at locations outside of the footprint of the handle base 12 when viewed from above in FIG. 6. The rolling base width 76 and the handle base width 26 are centered with each other so that the rolling base 16 extends beyond the handle base 12 in the lateral directions about the same amount to the right as it does the left. The rolling base length 78 and the handle base length 28 are centered with each other so that the rolling base 16 extends beyond the handle base 12 in the forward direction about the same amount as it does in the backward direction.

The larger sized rolling base 16 resists tipping of the walker 10. In contrast, some conventional walkers may rely on a weight of the walker to resist or prevent the walker from tipping. Conventional walkers may also assume the user will avoid applying their weight to lateral sides of the walker or applying force to move in lateral directions so as to not tip the walker. The relatively larger rolling base 16 of the illustrative walker 10 compared to handle base 12 may be helpful for pediatric users who may apply their weight to any portion of the handle base 12 and/or who may apply lateral forces asymmetrically to the walker 10 so that one side is biased or urged more than the other opposite side as they try to move in lateral directions. Illustrative ratios of widths and lengths are provided as non-exhaustive examples of how the rolling base 16 is large to resist or prevent tipping.

The rolling base width 76 and the handle base width 26 define a width ratio and the rolling base length 78 and the handle base length 28 define a length ratio. The width ratio is between about and including 1:1 and about and including 2:1 such that the rolling base width 76 may be about twice as large or more as the handle base width 26 in some embodiments. In some embodiments, the width ratio is between about and including 11:10 and about and including 2:1. In some embodiments, the width ratio is between about and including 5:4 and about and including 2:1. In some embodiments, the width ratio is between about and including 5:4 and about and including 11:6. In some embodiments, the width ratio is between about and including 4:3 and about and including 11:6.

In the illustrative embodiment, the width ratio is about 11:7. In some embodiments, the width ratio is about 5:3. In some embodiments, the width ratio is about 5:4. In some embodiments, the width ratio is about 4:3. In some embodiments, the width ratio is about 3:2. In some embodiments, the width ratio is about 11:10. In some embodiments, the width ratio is about 11:9. In some embodiments, the width ratio is about 11:8. In some embodiments, the width ratio is about 11:6. In some embodiments, the width ratio is about 11:5.

The length ratio is between about and including 1:1 and about and including 2:1 such that the rolling base length 78 may be about twice as large or more as the handle base length 28 in some embodiments. In some embodiments, the length ratio is between about and including 11:10 and about and including 2:1. In some embodiments, the length ratio is between about and including 5:4 and about and including 2:1. In some embodiments, the length ratio is between about and including 5:4 and about and including 11:7. In some embodiments, the length ratio is between about and including 5:4 and about and including 11:6. In some embodiments, the length ratio is between about and including 4:3 and about and including 11:6.

In the illustrative embodiment, the length ratio is about 5:3. In some embodiments, the length ratio is about 5:4. In some embodiments, the length ratio is about 4:3. In some embodiments, the length ratio is about 3:2. In some embodiments, the length ratio is about 11:10. In some embodiments, the length ratio is about 11:9. In some embodiments, the length ratio is about 11:8. In the some embodiments, the length ratio is about 11:7. In some embodiments, the length ratio is about 11:6. In some embodiments, the length ratio is about 11:5.

The legs 58 of each of the plurality of wheel units 62, 64, 66, 68 extend away from the frame 14 by an angle θ (Theta) as shown in FIG. 6. The angle θ is defined by the leg 58 and the corresponding frame rail 46, 48, 50 to which the leg 58 is coupled. Each of the plurality of wheel units 62, 64, 66, 68 may extend at the same angle θ value as in the illustrative embodiment. In some embodiments, each of the plurality of wheel units 62, 64, 66, 68 may extend at its own unique angles θ. In some embodiments, some, but not all, of the plurality of wheel units 62, 64, 66, 68 extend at the same angle θ. The angle θ (Theta) as provided herein may assist in resisting and preventing tipping of the base. The angle θ (Theta) may position the wheels and legs away from the user's feet, sides, and legs and therefore be out of the way when the user is walking.

The angle θ is between about 35 degrees and about 55 degrees. In the illustrative embodiment, the angle θ is about 45 degrees. In some embodiments, the angle θ is between about 40 degrees and about 50 degrees. In some embodiments, the angle θ is between about 45 degrees and about 50 degrees. In some embodiments, the angle θ is between about 40 degrees and about 45 degrees. In some embodiments, the angle θ is between about 35 degrees and about 45 degrees. In some embodiments, the angle θ is about 35 degrees. In some embodiments, the angle θ is about 40 degrees. In some embodiments, the angle θ is about 50 degrees. In some embodiments, the angle θ is about 55 degrees. As a result, the legs of the wheel units define angles between the legs of between about 80 and 100 degrees. In the illustrative embodiment, the legs of the wheel units are at 90 degree angles relative to the neighboring leg.

In the illustrative embodiment, the walker 10 is made of tubes and connectors comprising materials rigid enough to support the user, but also configured to allow the walker to bend and deform elastically under the weight of the user. Illustratively, the walker 10 is made of polyvinyl chloride (PVC) tubes and connectors. Polyvinyl chloride is relatively lightweight for its strength and tubes and connectors made of PVC may be readably available off the shelf at hardware stores. In other embodiments, the components may be metallic or any other suitable material and may be coupled together via fittings, bolts, welds, bonding, or any other suitable coupling means.

A kit 110 for making the walker 10 is shown in FIG. 8. The kit 110 includes a plurality of polyvinyl chloride tubes, a plurality of polyvinyl chloride 90-degree elbow fittings, a plurality of polyvinyl chloride tee fittings, a plurality of 3-way 90-degree elbow fittings, a plurality of 4-way tee fittings, and a plurality of wheels 60. The plurality of tubes include a first hand rail tube 120, a second hand rail tube 122, a third hand rail tube 124, a first frame rail tube 126, a second frame rail tube 128, a third frame rail tube 130, an upper first front arm tube 132, a lower first front arm tube 134, an upper second front arm tube 136, a lower second front arm tube 138, an upper first rear arm tube 140, a lower first rear arm tube 142, an upper second rear arm tube 144, a lower second rear arm tube 146, a first leg tube 148, a second leg tube 150, a third leg tube 152, and a fourth leg tube 154.

The plurality of 90-degree elbow fittings includes ten 90-degree elbow fittings 156. The plurality of tee fitting includes two tee fittings 158. The plurality of 3-way 90-degree elbow fittings includes two 3-way 90-degree elbow fittings 160. The plurality of 4-way tee fittings includes two 4-way tee fittings 162. The kit 110 further includes a four reducer connectors 164 and four wheel connectors 166. The walker kit 110 includes four wheels 60.

The first hand rail 20 is formed from the tube 120, a fitting 156, and a fitting 160 as suggested in FIG. 8. The second hand rail 22 is formed from the tube 122, a fittings 156, and fitting 160. The third hand rail 24 is formed from the tube 124 and the fittings 160.

The first front arm 36 is formed from the upper first front arm tube 132, the tee fitting 158, and the lower first front arm tube 134 as suggested in FIG. 8. The second front arm 38 is formed from the upper second front arm tube 136, a tee fitting 158, and the lower second front arm tube 138. The first rear arm 40 is formed from the upper first rear arm tube 140, the fitting 162, and the lower second rear arm tube 142. The second rear arm 42 is formed from the upper second rear arm tube 144, the fitting 162, and the lower second rear arm tube 146.

The first frame rail 46 is formed from the first frame tube 126, the tee fitting 158, and the fitting 162. The second frame rail 48 is formed from the second frame tube 128, the tee fitting 158, and the fitting 162. The third frame rail 50 is formed from the third frame tube 130, the fitting 162, and the other fittings 162.

The wheel unit 62 is formed from a wheel 60, a connector 166, an elbow 156, a reducer 164, a tube 148, and another elbow 156 as suggested in FIG. 8. The wheel unit 64 is formed from a wheel 60, a connector 166, an elbow 156, a reducer 164, a tube 150, and another elbow 156. The wheel unit 66 is formed from a wheel 60, a connector 166, an elbow 156, a reducer 164, a tube 152, and another elbow 156. The wheel unit 68 is formed from a wheel 60, a connector 166, an elbow 156, a reducer 164, a tube 154, and another elbow 156.

Some conventional walkers are heavy and may be difficult to maneuver. Such designs may be constructed with wide hand grips and made of dense materials which provide stability to the user and counterweighting to prevent tipping of the walker. Even still, this may have an adverse effect on the mobility of the user because the user may expend more effort moving the walker than moving themselves.

The user may be better able to support themselves when the handles of the walker are positioned closer the user's body. This may allow for direct load bearing through the arms of the user. In contrast, the wide grip of some conventional walkers moves the arms of the user further away from the waist limiting the load bearing of the user's arms. The wheel wide grip of such walkers may also limit mobility and only allow one-direction operation. Improvement is needed to limit the mass of the walker while still providing stability, and allow for multiple directions of operation (forward, backward, side-to-side, and angled directions).

The walker 10 of the present disclosure provides an improved size 76, 78 of the rolling base 16 with respect to the size 26, 28 of the handle base 12 as shown in FIG. 6. The wheels 60 of the illustrative walker 10 do not reside directly under the handle base 12. Instead, the rolling base 16 flares out at an angle to provide a wider wheel base footprint 76, 78 while minimizing the handle distance to user. The size 76, 78 of the rolling base 16 is significantly greater than the size 26, 28 of the handle base 12. The legs 58 are posited by an angle θ relative to the hand rails 20, 22, 24. This angle θ controls the ratio of 26:76 and 28:78.

The wide rolling base 16 with respect to the handle base 12 increases stability by shape of the walker 10 rather than the mass of the walker 10. The user can bias their weight bearing to either side of the walker 10 without tipping the walker 10. In contrast, a walker with wheels in-line with the handle base may be more prone to tipping.

The wheels 60 of the walker 10 are configured to swivel 360 degrees as suggested by the arrow around axis 70 in FIG. 7. This grants the user further mobility by allowing the walker 10 to move in any direction, as well as allowing the user to rotate the walker 360 degrees. The user may turn themselves inside the user space 18 relative to the walker 10 and then walk in any direction or the walker 10 itself can be rotated about the user. In other embodiments, less than all of the wheels are free to rotate 360 degrees. In some embodiments, two or more of the wheels are fixed in a single direction. In some embodiments, two or more of the wheels are configured to rotate 360 degrees about a vertical axis.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A walker comprising a handle base that includes a first hand rail, a second hand rail spaced apart from the first hand rail, and a third hand rail that extends between and interconnects the first hand rail and the second hand rail, wherein the first hand rail, the second hand rail, and the third hand rail each extend horizontally, a frame coupled with the handle base and configured to support the handle base above ground underlying the walker, the handle base and the frame cooperate to define a user space sized to allow a user of the walker to stand in the user space, the frame includes a plurality of arms and a plurality of frame rails, each of the plurality of arms extends vertically and perpendicular from the handle base, and each of the plurality of frame rails extends horizontally and interconnect the plurality of arms, and a rolling base coupled with the frame and configured to allow the walker to roll in all directions relative to the ground and to rotate freely along the ground about the user positioned in the user space, the rolling base including a plurality of wheel units coupled with the frame, and each of the plurality of wheel units includes a leg and a wheel coupled to the leg, and each leg extends horizontally from a corresponding one of the plurality of arms included in the frame outwardly away from the user space, wherein each leg is coupled to the frame via an elbow joint configured to elastically deform in response to the user applying their weight to the handle base to allow the frame and handle base to move downwardly toward the ground and provide a suspension effect for the walker.

2. The walker of claim 1, wherein each wheel included in the plurality of wheel units comprises a caster that extends downwardly away from the corresponding leg and at least one of the casters is configured to rotate 360 degrees relative to the corresponding leg about a vertical axis that intersects the corresponding leg.

3. The walker of claim 1, wherein a first leg of a first wheel unit included in the plurality of wheel units extends away from the first hand rail at an angle theta and the angle theta is between about and including 40 and 50 degrees.

4. The walker of claim 1, wherein the plurality of arms includes a first front arm coupled with and perpendicular to the first hand rail, a second front arm coupled with and perpendicular to the second hand rail, a first rear arm coupled with and perpendicular to the first hand rail and the third hand rail, and a second rear arm coupled with and perpendicular to the second hand rail and the third hand rail.

5. The walker of claim 4, wherein the plurality of frame rails includes a first frame rail coupled with the first front arm and the first rear arm, a second frame rail coupled with the second front arm and the second rear arm, and a third frame rail coupled with the first rear arm and the second rear arm, the first frame rail is parallel with and aligned with the first hand rail, the second frame rail is parallel with and aligned with the second hand rail, and a third frame rail that is parallel with and aligned with the third hand rail when viewed from above.

6. The walker of claim 5, wherein the plurality of wheel units includes a first wheel unit that includes a horizontal leg that extends from the from the first front arm, a second wheel unit that includes a horizontal leg that extends from the second front arm, a third wheel unit that includes a horizontal leg that extends from the first rear arm, and a fourth wheel unit that includes a horizontal leg that extends from the second rear arm.

7. The walker of claim 5, wherein the third handrail is perpendicular to the first hand rail and the second hand rail.

8. The walker of claim 1, wherein the handle base has a handle base width, the rolling base has a rolling base width, and the rolling base width is greater than the handle base width.

9. The walker of claim 8, wherein a width ratio between the rolling base width and the handle base width is between about and including 5:4 and about and including 11:6.

10. The walker of claim 9, wherein the handle base has a handle base length, the rolling base has a rolling base length, and the rolling base length is greater than the handle base length.

11. The walker of claim 10, wherein a length ratio between the rolling base length and the handle base length is between about and including 5:4 and about and including 11:6.

12. The walker of claim 1, wherein the handle base has a handle base length, the rolling base has a rolling base length, a length ratio between the rolling base length and the handle base length is between about and including 5:4 and about and including 11:6.

13. The walker of claim 12, wherein the handle base and the frame comprise polyvinyl chloride.

14. The walker of claim 1, wherein the first hand rail and a first leg of a first wheel unit included in the plurality of wheel units define an angle theta of between about and including 40 and 50 degrees, the handle base has a handle base width, the rolling base has a rolling base width, and a width ratio between the rolling base width and the handle base width is between about and including 5:4 and about and including 11:6.

15. The walker of claim 1, wherein the elbow joint of each leg is a 90-degree polyvinyl chloride elbow fitting to allow each leg to elastically deform and provide the suspension effect for the walker.

16. A walker comprising a handle base, a frame coupled with the handle base and configured to support the handle base above ground underlying the walker, the handle base and the frame cooperate to define a user space sized to allow a user of the walker to stand in the user space, and a rolling base coupled with the frame and configured to allow the walker to roll in all directions relative to the ground and to rotate freely along the ground about the user positioned in the user space, the rolling base including a plurality of wheel units coupled with the frame, and each of the plurality of wheel units extend from the frame outwardly away from the user space, wherein the handle base includes a first hand rail, a second hand rail spaced apart from the first hand rail, and a third hand rail that extends between and interconnects the first hand rail and the second hand rail and wherein the first hand rail, the second hand rail, and the third hand rail each extend substantially horizontally, wherein the frame includes a plurality of arms that extends vertically and perpendicularly from the handle base and a plurality of frame rails that extend horizontally and interconnect the plurality of arms, wherein the plurality of arms includes a first front arm coupled with the first hand rail, a second front arm coupled with the second hand rail, a first rear arm coupled with the first hand rail and the third hand rail, and a second rear arm coupled with the second hand rail and the third hand rail, wherein the plurality of frame rails includes a first frame rail coupled with the first front arm and the first rear arm, a second frame rail coupled with the second front arm and the second rear arm, and a third frame rail coupled with the first rear arm and the second rear arm, wherein the plurality of wheel units includes a first wheel unit that includes a horizontal leg that extends from the from the first front arm, a second wheel unit that includes a horizontal leg that extends from the second front arm, a third wheel unit that includes a horizontal leg that extends from the first rear arm, and a fourth wheel unit that includes a horizontal leg that extends from the second rear arm, wherein each of the plurality of wheel units includes a wheel coupled to the leg of the wheel unit, each wheel is a caster that extends downwardly away from the corresponding leg, and the caster is configured to rotate 360 degrees relative to the corresponding leg about a vertical axis that intersects the corresponding leg, wherein each horizontal leg is coupled to the frame via an elbow joint configured to elastically deform in response to the user applying their weight to the handle base to allow the frame and handle base to move downwardly toward the ground and provide a suspension effect for the walker, and wherein the handle base has a handle base width, the rolling base has a rolling base width, and the rolling base width is greater than the handle base width, a width ratio between the rolling base width and the handle base width is between about and including 5:4 and about and including 11:6, the handle base has a handle base length, the rolling base has a rolling base length, the rolling base length is greater than the handle base length, and a length ratio between the rolling base length and the handle base length is between about and including 5:4 and about and including 11:6.

17. A walker comprising a polyvinyl chloride handle base that includes a first hand rail, a second hand rail spaced apart from the first hand rail, and a third hand rail that extends between and interconnects the first hand rail and the second hand rail, wherein the first hand rail, the second hand rail, and the third hand rail each extend horizontally, a polyvinyl chloride frame coupled with the handle base and configured to support the handle base above ground underlying the walker, the handle base and the frame cooperate to define a user space sized to allow a user of the walker to stand in the user space, the frame includes a plurality of arms that extends vertically and perpendicular from the handle base and a plurality of frame rails that extend horizontally and interconnect the plurality of arms, and a rolling base coupled with the frame and configured to allow the walker to roll in all directions relative to the ground and to rotate freely along the ground about the user positioned in the user space, the rolling base including a plurality of wheel units coupled with the frame, and each of the plurality of wheel units includes a polyvinyl chloride leg and a wheel coupled to the polyvinyl chloride leg, and each polyvinyl chloride leg extends horizontally from corresponding ones of the plurality of arms included in the frame outwardly away from the user space, wherein each leg is coupled to the frame via a 90-degree polyvinyl chloride elbow fitting configured to elastically deform in response to the user applying their weight to the handle base to allow the frame and handle base to move downwardly toward the ground and provide a suspension effect for the walker.

18. The walker of claim 17, wherein the plurality of arms includes a first front arm coupled with and perpendicular to the first hand rail, a second front arm coupled with and perpendicular to the second hand rail, a first rear arm coupled with and perpendicular to the first hand rail and the third hand rail, and a second rear arm coupled with and perpendicular to the second hand rail and the third hand rail.

19. The walker of claim 18, wherein the third handrail is perpendicular to the first hand rail and the second hand rail.

20. The walker of claim 19, wherein the polyvinyl chloride handle base includes only three hand rails and the polyvinyl chloride frame includes only three arms and three frame rails so that the polyvinyl chloride handle base and the polyvinyl chloride frame provide an unblocked open side for the user to enter the user space.

* * * * *